US007223251B1

(12) United States Patent
Cassidy Phillips

(10) Patent No.: US 7,223,251 B1
(45) Date of Patent: May 29, 2007

(54) MASSAGE DEVICE

(76) Inventor: Peter L. Cassidy Phillips, 1136 Whitshire Way, Alpharetta, GA (US) 30004

( * ) Notice: Subject to any disclaimer, the term of this patent is extended or adjusted under 35 U.S.C. 154(b) by 550 days.

(21) Appl. No.: 10/634,031

(22) Filed: Aug. 4, 2003

Related U.S. Application Data

(60) Provisional application No. 60/401,188, filed on Aug. 5, 2002.

(51) Int. Cl.
*A61H 15/00* (2006.01)

(52) U.S. Cl. ..... 601/118; 601/121

(58) Field of Classification Search ..... 601/118, 601/119, 115, 120–127, 117, 129–137, 28, 601/27, 99, 104, 32
See application file for complete search history.

(56) References Cited

U.S. PATENT DOCUMENTS

| | | | | | |
|---|---|---|---|---|---|
| 598,773 | A | | 2/1898 | Figge | |
| 744,718 | A | | 11/1903 | Cassidy | |
| 1,672,944 | A | * | 6/1928 | Jowett | 482/108 |
| 1,991,520 | A | * | 2/1935 | Postl | 482/108 |
| 2,221,785 | A | * | 11/1940 | Douglas | 601/120 |
| 2,229,170 | A | * | 1/1941 | Greene | 473/354 |
| 2,258,333 | A | * | 10/1941 | Miller | 473/364 |
| 2,920,418 | A | * | 1/1960 | Britt | 446/241 |
| 3,067,738 | A | * | 12/1962 | Karlik | 601/120 |
| 3,298,687 | A | * | 1/1967 | Douglas | 482/132 |
| 3,419,268 | A | * | 12/1968 | Bellet | 482/132 |
| 3,762,053 | A | * | 10/1973 | Day | 33/1 BB |
| 4,846,159 | A | | 7/1989 | Anzai et al. | 128/57 |
| 5,346,449 | A | * | 9/1994 | Schlagel | 482/107 |
| 5,577,995 | A | * | 11/1996 | Walker et al. | 601/120 |
| 5,725,484 | A | | 3/1998 | Burnham | 601/128 |
| 5,824,013 | A | * | 10/1998 | Allen | 606/240 |
| 5,830,161 | A | * | 11/1998 | Cosmano | 601/121 |
| D403,076 | S | | 12/1998 | York | D24/214 |
| 5,868,689 | A | | 2/1999 | Faroky et al. | 601/120 |
| 6,093,159 | A | | 7/2000 | Racoosin | 601/131 |
| 6,146,343 | A | * | 11/2000 | Stewart | 601/118 |
| 6,210,304 | B1 | * | 4/2001 | Scatterday | 482/49 |
| 6,241,696 | B1 | | 6/2001 | York | 601/137 |
| 6,499,485 | B1 | * | 12/2002 | Pepera | 128/845 |
| 6,638,184 | B2 | * | 10/2003 | Nesbitt et al. | 473/372 |
| 6,645,089 | B2 | * | 11/2003 | Tsunoda et al. | 473/371 |
| 6,784,127 | B1 | * | 8/2004 | Yamakawa et al. | 442/409 |

* cited by examiner

*Primary Examiner*—Patricia Bianco
*Assistant Examiner*—Huong Q. Pham
(74) *Attorney, Agent, or Firm*—R. Keith Harrison

(57) ABSTRACT

A massage device which substantially mirrors the hardness and deformation characteristics of the human thumb or palm and is particularly effective in relieving tender and painful muscle and connective tissue conditions, including but not limited to trigger points, foot ailments and leg and arm ailments such as carpel tunnel syndrome. The massage device typically includes an elongated, resilient massage body. A pair of spaced-apart wheels is provided on the massage body to facilitate rolling the device on a surface. The wheels of the massage device may be rolled in a back-and-forth motion on a flat surface as the afflicted area or areas on an arm, leg, foot or other part of a user's body is pressed against the resilient massage body to substantially alleviate pain and discomfort associated with muscle or connective tissue conditions.

2 Claims, 2 Drawing Sheets

MASSAGE DEVICE

CROSS-REFERENCE TO RELATED APPLICATIONS

This application claims the benefit of provisional application No. 60/401,188, filed Aug. 5, 2002, and is related to my utility patent application Ser. No. 10/419,460, filed Apr. 21, 2003.

FIELD OF THE INVENTION

The present invention relates to therapeutic body massage devices, and more particularly, to a multi-layered massage device which substantially mirrors the hardness and deformation characteristics of the human thumb or palm and is particularly effective in relieving tender and painful conditions such as muscle or connective tissue conditions, including but not limited to trigger points.

BACKGROUND OF THE INVENTION

The art of massage has long been used to relieve various muscle, tendon and other connective tissue ailments. The kneading of muscles, for example, imparts a modification to the muscle tissue that acts beneficially on the nerves, the muscles being controlled by the nerves in both their movement and nourishment, health of the muscle tissue due to improved blood circulation, and effusion of waste material from the muscle and connective tissues. Accordingly, numerous devices are known in the art for massaging muscles or other tissues.

A "trigger point" is a common type of connective tissue injury which may be caused by conditions including but not limited to long periods of sitting, repetition of movement, poor biomechanics, myofacia accumulation, electrolyte depletion, salt deficiency, or general muscle over-use. A trigger point is a discrete knot or tight, ropy band of muscle that forms when a muscle fails to relax. The knot often can be felt under the skin and may twitch involuntarily when touched. This is known as a "jump sign". Trigger points can trap or irritate nerves surrounding the affected tissue and cause referred pain, or pain which originates in one part of the massage body and is felt in another (such as pain from a heart attack that is felt in the jaw or arm). Scar tissue, loss of range of motion and muscle weakness may occur over time as a result of a trigger point. Accordingly, a new and improved message device is needed which is particularly effective in relieving pain and discomfort associated with trigger points as well as other muscle or connective tissue ailments such as foot pain, Achilles tendon ailments, planar fasciatas, calf and heel pain, and carpel tunnel syndrome. Furthermore, a massage device is needed which mirrors the hardness and deformation characteristics of the flesh on the human thumb or palm, is effective in creating elasticity in the belly of muscle tissue and is capable of hands-free use by physically handicapped or debilitated persons.

SUMMARY OF THE INVENTION

The present invention is generally directed to a massage device which substantially mirrors the hardness and deformation characteristics of the human thumb or palm and is particularly effective in relieving tender and painful muscle and connective tissue conditions, including but not limited to trigger points, foot ailments and leg and arm ailments such as Achilles tendon ailments and carpel tunnel syndrome. The massage device typically includes an elongated, resilient massage body. A pair of spaced-apart wheels is provided on the massage body to facilitate rolling the device on a surface. The wheels of the massage device may be rolled in a back-and-forth motion on a flat surface as the afflicted area or areas on an arm, leg, foot or other part of a user's body is pressed against the resilient massage body to substantially alleviate pain and discomfort associated with muscle or connective tissue conditions.

BRIEF DESCRIPTION OF THE DRAWINGS

The invention will be better understood, by way of example, with reference to the accompanying drawings, in which.

DETAILED DESCRIPTION OF THE INVENTION

Figures 1, 2:
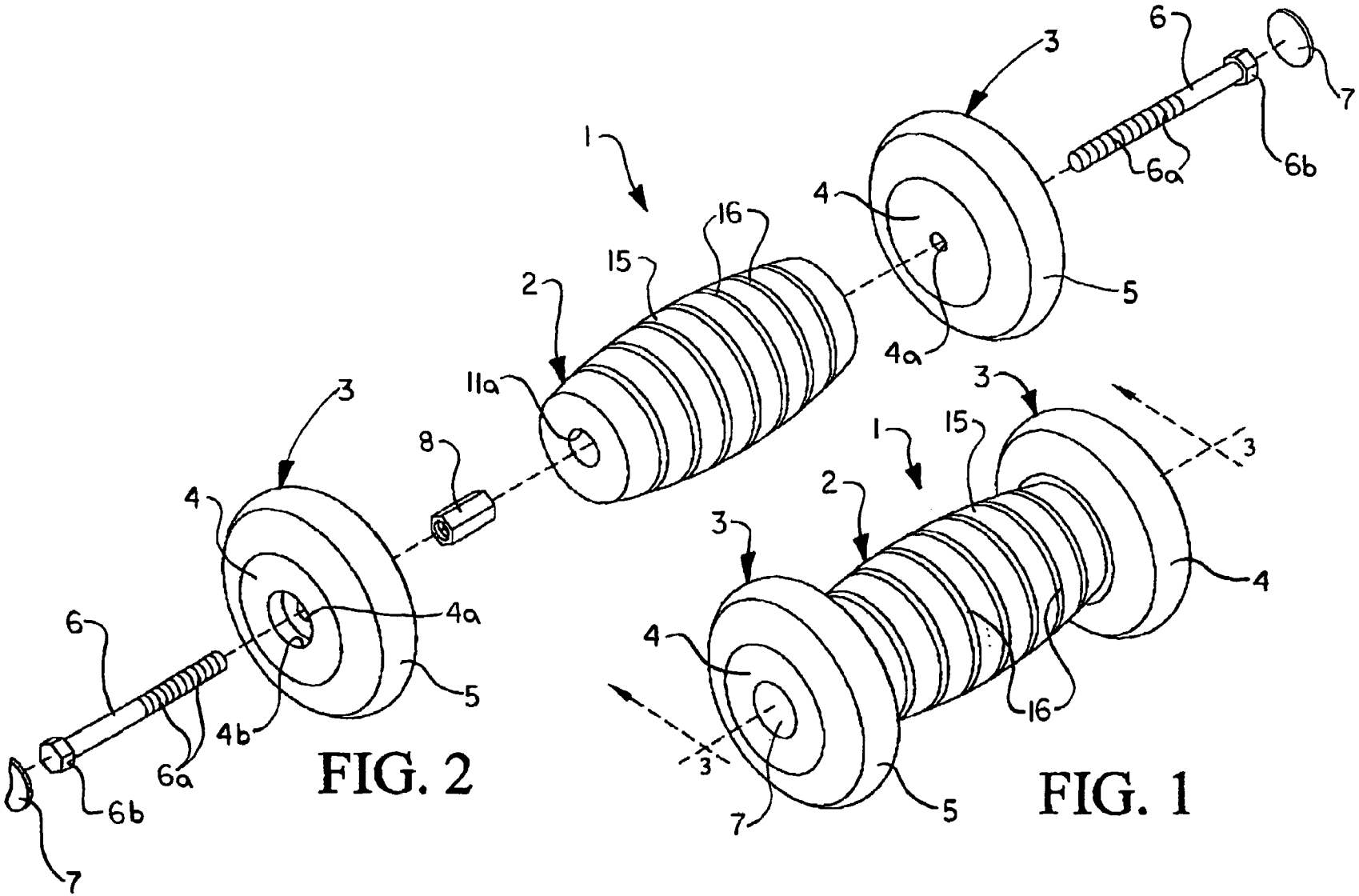
FIG. 1 is a perspective view of an illustrative embodiment of the massage device of the present invention.
FIG. 2 is an exploded, perspective view of the massage device.
Figure 3:
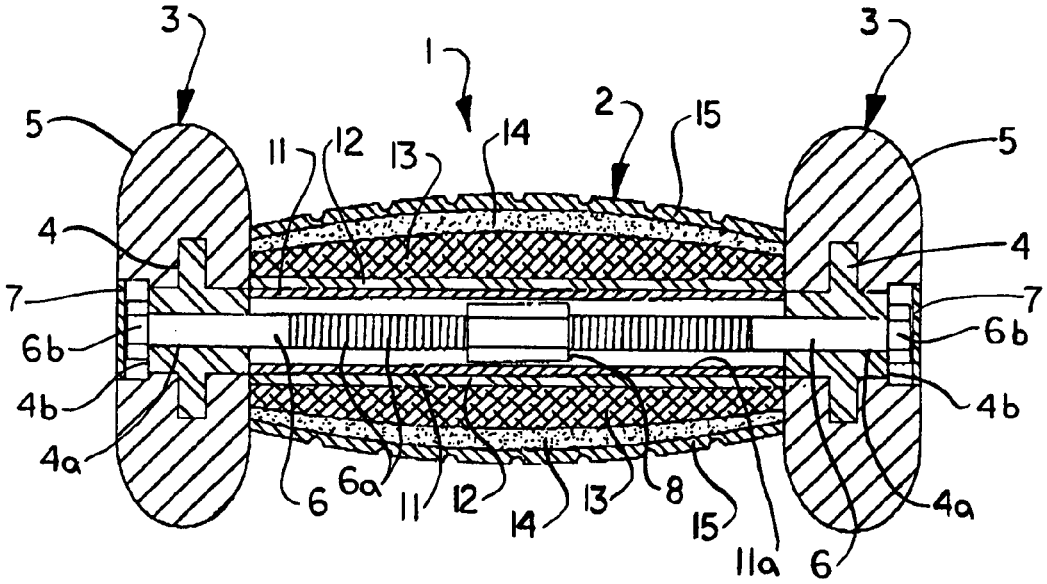
FIG. 3 is a longitudinal sectional view, taken along section lines 3—3 in FIG. 1.

Referring initially to FIGS. 1–3A of the drawings, an illustrative embodiment of the massage device of the present invention is generally indicated by reference numeral 1. As shown in FIGS. 1 and 2, the massage device 1 includes a generally elongated massage body 2 and a pair of spaced-apart wheels 3, each of which may be polyurethane, for example, provided typically on respective ends of the massage body 2. Each wheel 3 typically includes a hub 4 which is mounted to the massage body 2 and an outer portion 5 provided on the hub 4. As shown in FIGS. 2 and 3, each wheel 3 may be mounted on a corresponding end of the massage body 2 using a bolt 6 having bolt threads 6*a* and a bolt head 6*b*, typically in the manner hereinafter described.

As further shown in FIG. 3, the massage body 2 typically includes an elongated, typically tubular core 11 which may have a tube bore 11*a*; an inner elastic layer 12 surrounding the core 11; a compressive layer 13 surrounding the inner elastic layer 12; an outer elastic layer 14 surrounding the compressive layer 13; and a cover 15 which surrounds the elastic layer 14. These layers impart compression-resistance and deformation characteristics to the massage device 1 which substantially mirror the compression-resistance and deformation characteristics of the flesh on a human thumb or palm. These characteristics enable the massage device 1 to function in the same manner as the fingers or hand of a massage therapist in the treatment of muscular or other connective tissue ailments. The massage device 1 is effective in relieving pain and discomfort associated with a variety of muscle and connective tissue ailments, and may further be used as a tool for the prevention of trigger points and other muscular and connective tissue ailments.

As shown in FIG. 3, the core 11 of the massage device 1 may be an elongated tube or pipe which may be polyvinylchloride (PVC), for example. Alternatively, the core 11 may be any substantially firm, rigid, tubular or solid material including wood, polyurethane, plastic or metal, in non-exclusive particular. The core 11 mirrors the firm or rigid consistency of the bone in the human thumb. The substantially firm or rigid core 11 further functions as a support base which renders the massage device 1 capable of supporting a substantial compressive load or pressure without excessive deformation, and imparts necessary weight to the massage device 1.

The core 11 further functions as a structure for mounting the wheels 3 on the massage body 2. As shown in FIG. 2, each bolt 6 extends through a central bolt opening 4*a* and bolt head cavity 4*b* provided in the hub 4, and into the tube bore 1*a* of the core 11, as shown in FIG. 3. Accordingly, the bolts 6 are disposed in substantially axially-aligned relationship to each other in the tube bore 11*a*. A bolt coupling 8 in the tube bore 11*a* engages the bolt threads 6*a* of both bolts 6 to secure the bolts 6 to each other and the wheels 3 on the massage body 2, with the bolt head 6*b* of each bolt 6 seated in the bolt head cavity 4*b* of the corresponding wheel 3, as shown in FIG. 3. A bolt cap 7 may be inserted in each bolt head cavity 4*b*.

Figure 3A:
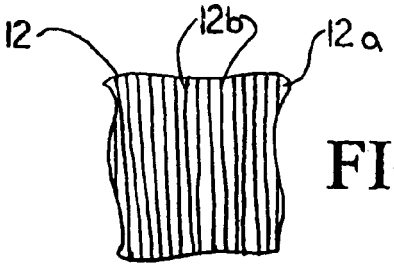
FIG. 3A is a is a top view of an elastic layer, partially in section, of the massage device.

The inner elastic layer 12 is typically any type of self-adherent wrap having an elastic memory, such as, for example, elastic gauze including natural rubber latex. As shown in FIG. 3A, the inner elastic layer 12 typically includes a laminate of non-woven material 12*a* having multiple, parallel elastic fibers 12*b* extending through the non-woven material 12*a*. The elastic fibers 12*b* may be natural rubber latex, for example. In a typical embodiment, the inner elastic layer 12 is COBAN (trademark), available from the 3M corporation, although other types of elastic non-woven material 3*a* including the typically latex elastic fibers 3*b* may be used instead. Typically, the inner elastic layer 12 has a thickness of about 1 mm and may be applied over the tubular core 11 as a sheet. The typically self-adhesive characteristic of the inner elastic layer 12 causes the inner elastic layer 12 to partially grip both the outer surface of the core 11 and the inner surface of the compressive layer 13, which surrounds the inner elastic layer 12 as hereinafter described. This prevents excessive sliding between the core 11 and the compressive layer 13 during use of the massage device 1, as hereinafter described. The inner elastic layer 12 mirrors the density, hardness and deformation characteristics of the fascia which surrounds the bone in a human thumb or palm.

The compressive layer 13 surrounds the inner elastic layer 12 and may be an elastic bandage fabric such as a cotton twill fabric, an ACE (trademark) bandage, a jersey knit material, a knit cotton fabric or elastic gauze, in non-exclusive particular. The compressive layer 13 has a thickness of typically about 6 mm and covers the entire circumference of the inner elastic layer 12, and may be applied over the inner elastic layer 12 as a sheet. The compressive layer 13 imparts to the massage body 2 compression-resistance, deformation and density characteristics which substantially mirror those of the muscle in the human thumb or palm.

The outer elastic layer 14 surrounds the compressive layer 13. The outer elastic layer 14 is typically the same materially as the inner elastic layer 12 and may be an elastic, self-adherent wrap such as elastic gauze, for example, and including a laminate of non-woven material 12*a* having multiple, parallel elastic fibers 12*b*, typically natural rubber latex, extending through the non-woven material 12*a*, as heretofore described with respect to the inner elastic layer 12 in FIG. 3. The outer elastic layer 14 mirrors the density, hardness and deformation characteristics of the fascia which surrounds human muscle in the thumb or palm. An example of a suitable material for the outer elastic layer 14 is COBAN (trademark), available from the 3M corporation. Like the inner elastic layer 12, the outer elastic layer 14 has a thickness of typically about 1 mm. The outer elastic layer 14 may be applied over the compressive layer 13 as a sheet. The typically self-adhesive nature of the outer elastic layer 14 causes it to grip the outer surface of the compressive layer 13, which is encapsulated by the outer elastic layer 14, and the inner surface of the cover 15, which encapsulates the compressive layer 13, thus preventing excessive sliding between the cover 15 and the compressive layer 13 during use of the massage device 1, hereinafter described.

The cover 15 typically surrounds the outer elastic layer 14 and may have any selected design, color and appearance, such as multiple stripes 16, for example, as shown in FIG. 1. The cover 15 may be a polyethylene/cotton knit, combed cotton fabric, rubber, latex, lycra, poly-lycra, rib knit fabric, canvas, pleather or leather, in non-exclusive particular. Typically, the cover 15 has a thickness of about 1 mm and is applied over the outer elastic layer 14 as a sheet.

Figure 4:
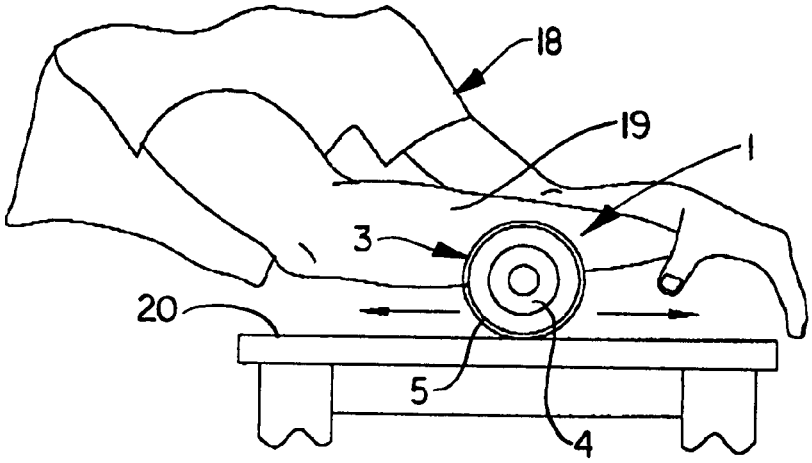
FIG. 4 is a side view of the massage device, more particularly illustrating a typical manner of use in which the massage device is rolled in a back-and-forth motion on a flat surface as an afflicted area on a user's forearm is rolled against the device, in one of multiple examples of using the massage device.

Referring next to FIG. 4, in typical application the massage device 1 can be used to relieve pain and discomfort associated with trigger points, spasms and other muscular ailments, as well as pain and discomfort which accompanies foot, arm and other connective tissue ailments such as carpel tunnel syndrome, for example. Accordingly, in the event that a muscle in the forearm 19 of a user 18 is afflicted with pain or discomfort caused by a trigger point and/or muscle spasm, for example, the user 18 initially places the wheels 3 of the massage device 1 on a firm, smooth support surface 20, such as a table. The user 18 then presses the region of his or her forearm 19 beneath which the afflicted muscle extends, against the massage body 2 of the massage device 1 and repeatedly rolls the forearm 19 against the massage body 2 in a back-and-forth motion as the wheels 3 roll on the support surface 20, as indicated by the arrows. As the forearm 19 is applied against the massage body 2 for about 5–7 seconds of continuous and steady pressure, the massage body 2 gradually deforms about 1–3 cm to change shape and generally conforms to the configuration of the surface on the forearm 19 against which the massage body 2 is pressed. Accordingly, the massage body 2 applies pressure which penetrates the belly of the afflicted muscle without damaging the muscle tissue. As the massage body 2 thus changes shape, the user 18 continues to roll his or her forearm 19 against the massage body 2 against the affected area in a generally back-and-forth motion. The pressure applied to the affected area by the massage body 2 increases flow of oxygenated blood or blood and oxygen to the muscle afflicted with the trigger point and/or spasms, creating elasticity in the belly of the muscle and relieving the associated pain and discomfort. This procedure is applied as often as is necessary to relieve the pain and discomfort and eliminate the condition. It will be appreciated by those skilled in the art that repeated use of the massage device 1 in the manner heretofore described is effective not only in relieving the pain and discomfort associated with trigger points, spasms, carpel tunnel syndrome, Achilles tendon ailments or other muscular or connective tissue afflictions, but also in preventing additional occurrences of the pain or discomfort. It will be further appreciated that the massage device 1 provides a safe and effective way for a person to manipulate muscle or connective tissue on his or her own, without requiring the manual kneading action of a massage therapist.

In an alternative manner of use, the massage body 2 of the massage device 1 is manually pressed against an afflicted muscle in an arm, leg, or other region on the massage body of a user. The user rolls the massage body 2 of the massage device 1 against the affected area in a back-and-forth motion while continuing to apply pressure against the massage body 2 until the pain and discomfort in the affected area is relieved. It will be appreciated by those skilled in the art that the massage device 1 may be used to massage any portion of the body, including but not limited to the legs, arms or feet, in the manner heretofore described.

It is understood that numerous variations of the massage device 1 having the multi-layered massage body 2 as heretofore described are possible without departing from the scope of the invention. For example, the message body 2 may include the core 11, typically having a substantially hollow or solid material, in addition to one or more elastic layers such as the inner elastic layer 12 and/or outer elastic layer 14, one or more compressive layers such as the compressive layer 13, or one or more elastic layers in combination with one or more compressive layers, typically in addition to the cover 15. However, the optimum compression resistance (hardness), deformation characteristics and density, which preferably mirror those characteristics of the human thumb or palm, are achieved by providing the core 11, the inner elastic layer 12, the compressive layer 13, the outer elastic layer 14, and the cover 15, respectively, in the manner heretofore described with respect to FIG. 3. It is understood that the wheels 3 may be provided on the massage body 2 using any technique other than or in addition to the bolts 6, according to techniques known by those skilled in the art.

While the preferred embodiments of the invention have been described above, it will be recognized and understood that various modifications can be made in the invention and the appended claims are intended to cover all such modifications which may fall within the spirit and scope of the invention.

Having described my invention with the particularity set forth above, I claim:

1. A massage device comprising:

a generally elongated massage body including a substantially rigid core, an inner elastic layer surrounding said core, a compressive layer surrounding said inner elastic layer, and an outer elastic layer surrounding said compressive layer and having a first end and a second end spaced-apart from said first end;

spaced-apart circular wheels carried by said first end and said second end, respectively, of said massage body, said wheels having hubs, respectively, provided on said core and outer portions provided on said hubs, respectively;

wherein said massage body has a continuous convex configuration between said first end and said second end of said massage body;

a pair of bolts extending through said hubs of said wheels, respectively, and into said core; and a bolt coupling provided in said core and connecting said pair of bolts.

2. The massage device of claim 1 further comprising a cover surrounding said outer elastic layer.

* * * * *